United States Patent [19]

Savage et al.

[11] 4,210,163

[45] Jul. 1, 1980

[54] HAIR ROLLER DEVICE

[75] Inventors: Paul F. Savage, Plymouth, Mass.; Michael R. Pye, Cambridge, England

[73] Assignee: The Gillette Company, Boston, Mass.

[21] Appl. No.: 970,746

[22] Filed: Dec. 18, 1978

[51] Int. Cl.[2] ..... A45D 2/06

[52] U.S. Cl. ..... 132/33 R; 132/34 R

[58] Field of Search ..... 132/33 R, 9, 34 R, 1 R

[56] References Cited

U.S. PATENT DOCUMENTS

| | | | |
|---|---|---|---|
| 2,487,125 | 11/1949 | Gillehand | 132/34 R |
| 2,575,184 | 11/1951 | Moses et al. | 132/33 R |
| 3,148,685 | 9/1964 | Haynes et al. | 132/33 R |
| 3,173,429 | 3/1965 | Pauldine | 132/33 R |
| 3,413,984 | 12/1968 | Tracy et al. | 132/34 R |
| 3,426,766 | 2/1969 | Castellano | 132/34 R |
| 3,483,876 | 12/1969 | Planel | 132/33 R |
| 4,029,110 | 6/1977 | Hyland | 132/9 |

*Primary Examiner*—Paul J. Hirsch

*Attorney, Agent, or Firm*—Richard A. Wise; Raymond J. De Vellis

[57] ABSTRACT

A non-electric hair roller device is utilized with a plurality of generally cylindrical heat conductive rollers of different diameters as a curling iron or hair setter. The hair roller device is non-conductive and includes at least one support leg which is pivotable and compressible with respect to the rod portion of the device and the stack-up height of the support leg and the rod portion is greater than the inside diameter of the largest conductive roller to assure that the roller is retained on the hair roller device even in a roller down orientation.

10 Claims, 7 Drawing Figures

HAIR ROLLER DEVICE

BACKGROUND OF THE INVENTION

The present invention relates to a hair roller device which is used for hair curling and the like.

More particularly, the present invention relates to a hair roller device which in combination with a plurality of different diameter heat-conductive smooth rollers may perform both the function of a curling iron and a hair setter device. The conductive or metal rollers are heated and/or dispensed such as in a heating chamber through conduction, radiation or the like. Examples are shown in U.S. Pat. Nos. 3,948,417 and 3,454,318. The hair roller device is utilized to engage and manipulate the heated rollers in a safe manner and allow the curling handle to be used with the metal roller as a curling iron or allow the roller to be left in the hair by use of an associated non-conductive clamp, bobbie pin, or the like. Examples of suitable clamps are shown in U.S. Pat. No. 429,984 and German OLS No. 1,457,386. Typically, curling appliances were either of the curling iron or hair setting variety. The trend of such appliances has gravitated toward electrically heated curling irons on the one hand and insulated or non-conductive rollers on the other.

Electrically heated curling irons which were used in combination with conductive rollers, such as depicted in U.S. Pat. No. 3,291,141, were only usable as a curling iron and required relatively exacting tolerances and a set of conductive teeth and a split roller combination to insure proper heating of the conductive rollers by the conductive rod portion of the electrically heated curling iron.

Devices such as depicted in U.S. Pat. Nos. 3,413,984 and 3,426,766 were capable of engaging rollers of different diameter but were designed primarily for non-conductive rollers and were most complex. For example, the U.S. Pat. No. 3,426,766 required the manipulation of a washer to adjust the deformation of a plurality of flexible staves. Such an arrangement could readily result in an insufficient force to retain the roller in the roller down position. When a hot roller is being manipulated, too great a force on the roller would render it too difficult to operate effectively as a hair setter, i.e. leaving the roller in the hair, and too little force may result in the hot roller falling off the hair roller device and possibly causing an injury such as a burn to the user of the device.

The U.S. Pat. No. 3,413,984, in its modified form embodiment of FIG. 4, utilizes a two tine arrangement of resilient material to wedge into an associated roller. This construction may cause an orientation problem in securing the roller with its resulting uneven or improper curl and also require too great a force, especially with respect to the smallest diameter roller when the roller is removed and left in the hair. Both U.S. Pat. Nos. 3,426,766 and 3,413,984 devices could not be used with hot, heat conductive rollers without a danger that the user burn him or herself especially during the initial retaining of the roller on the hair roller device.

Briefly stated and according to an embodiment of this invention, the problems with prior art devices have been overcome by the practice of this invention which includes a non-electric non-conductive hair roller device including a normally biased clip member for frictionally holding a roller on the hair roller device and at least one compressible support leg pivotably mounted on the roller device which is of a height in combination with the rod, greater than the inside diameter of any utilized roller to provide sufficient retaining of the roller even when the clip member is released from the roller.

SUMMARY OF THE INVENTION

It is therefore an object of this invention to provide a hair roller device which is capable of use with a plurality of various diameter metal rollers both as a curling iron and as a hair setter appliance.

It is a further object of this invention to provide a safe, easy to manufacture and cost effective, multi-functioned hair roller device.

It is a further object of this invention to provide a hair roller device used in combination with heat conductive rollers which is capable of retaining various size rollers on the device even when an associated hair clip does not frictionally engage the roller.

BRIEF DESCRIPTION OF THE DRAWINGS

The invention both as to its organization and principle of operation, together with further objects and advantages thereof, may better be understood by reference to the following detailed description of the embodiment of the invention taken in conjunction with the accompanying drawings in which.

DETAILED DESCRIPTION OF THE PREFERRED EMBODIMENT

Figure 1:
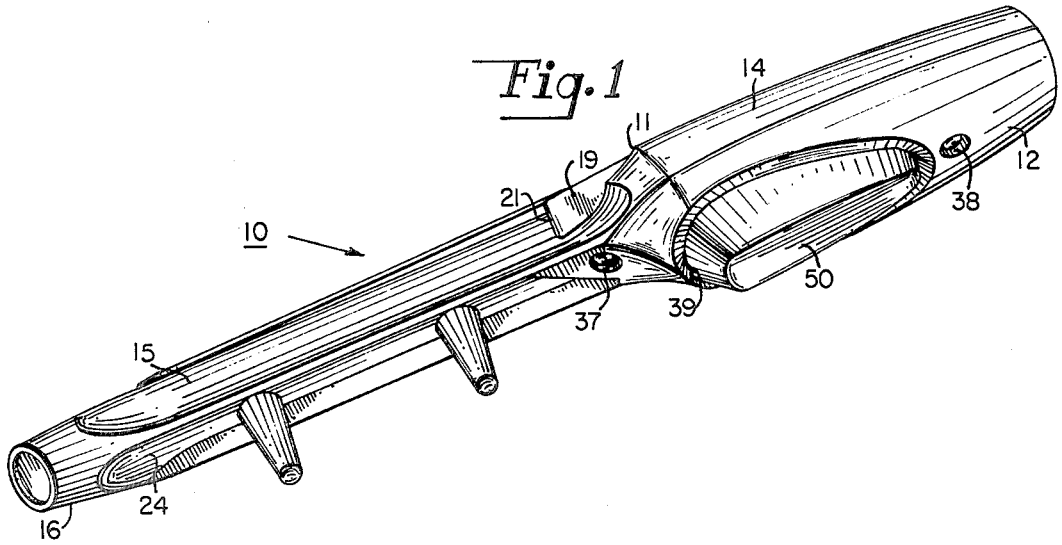
FIG. 1 is a perspective view of the hair roller device in accordance with this invention.

Referring now to the drawings where the same reference number will designate like parts, the hair roller device 10 is depicted in perspective in FIG. 1. The hair roller device 10 includes an upper member 11, a lower handle portion 12, and a clip assembly 13 which can better be seen when referring to FIG. 4.

The upper member 11 includes upper handle portion 14 and integrally molded rod portion 15 and is formed of a non-conductive plastic such as polyester or the like. The choice of non-conductive material is made to minimize the heat absorption by the rod when it is in contact with a hot roller.

The rod portion 15 at its far end includes a cool tip portion 16 which may be grasped by the user of the hair roller device 10 and manipulated such as by turning to get the desired curl results. The rod portion 15 has a generally triangular cross-sectional area as can best be seen in reference to FIG. 5 and includes generally concave side walls 17 and 18 integrally formed between the cool tip portion 16 and the upper handle portion 14. The choice of the geometry of the rod portion 15 is dictated by concerns to reduce the mass of the rod portion to achieve ease of handling of the hair roller device 10 and minimize heat loss.

Figure 5:
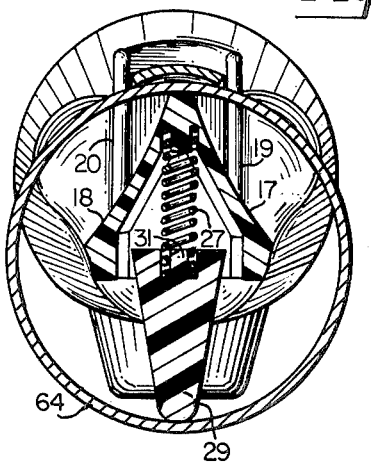
FIG. 5 is an end view taken in cross-section along lines 5—5 and includes a roller in accordance with this invention.

Also included on the upper member 11 are integrally molded upstanding wall member 19 and 20, best seen in FIG. 5. Each wall member at its edge toward the cool tip 16 include a stop edge such as stop edge 21 on wall member 19 which provides a convenient stop for the mounted roller. The wall members 19 and 20 also define a guide for a portion of the clip assembly 13, to be described later, and also define an aperture 22 for receiving a portion of the clip assembly 13.

Figure 2:
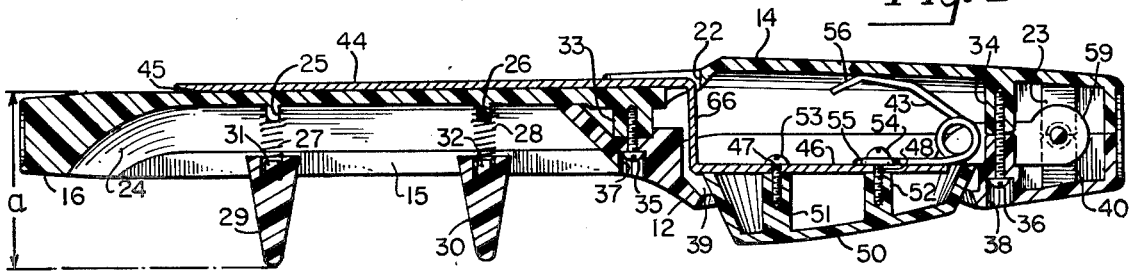
FIG. 2 is a cross-sectional side view of the hair roller device in which the associated clip member is in its normally biased position in accordance with this invention.
Figure 3:
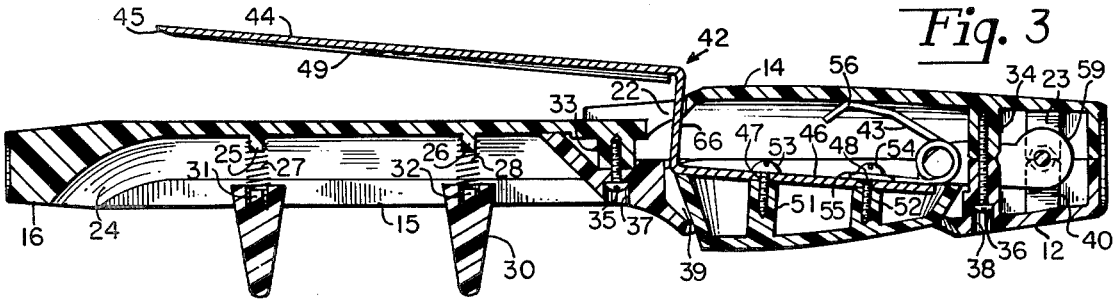
FIG. 3 is a cross-sectional side view of the hair roller device in which an associated button is depressed thereby moving a portion of a clip member away from the rod rod portion of the hair roller device in accordance with this invention.

In addition, the upper member 11 has integrally molded upper mounting members such as upper mounting member 23, best shown in FIGS. 2 and 3, in the rear of the upper handle portion 12. Upper mounting member 23 and its mirror image (not shown) are used to provide the pivot structure for the clip assembly 13 in a manner to be described later.

Integrally formed in the bottom portion of the rod portion 15 is a generally triangular longitudinal groove 24 which runs substantially the length of the rod portion 15 of the upper member 11. The longitudinal groove 24 not only lessens the mass of the rod portion 15, but also provides clearance which allows support leg means, to be described subsequently, to move in a forward direction toward the cool tip 16 and a rearward direction toward the upper handle portion 14.

Integrally molded in the apex of the longitudinal groove 24 of the rod portion 15 are pegs 25 and 26. The first ends of standard compression springs 27 and 28 are disposed about the circumference of pegs 25 and 26 or connected to their respective pegs 25 and 26 in other state of the art manners. The second ends of the compression springs 27 and 28 are connected to a generally conically shaped leg member with a rounded tip such as leg members 29 and 30. The second end of the compression springs 27 and 28 are wound around or otherwise fixed to pegs 31 and 32 respectively which are integrally molded inside an aperture at the flat end of the leg members 29 and 30. The leg members 29 and 30 are likewise constructed of a non-heat conductive plastic such as polyester. Many alternate leg means acting as spring grips and including a compressible portion as well as being movable in the forward and reverse direction are considered within the scope of this invention. The critical height between the rounded tip of the leg members 29 and 30 and the top of the rod portion 15 which is most proximate the horizontal portion of the clip assembly 13 when the compression spring is in its relaxed or normal position is defined as the stack-up height "a" of the device as shown in FIG. 2. Completing the description of the upper member 11, threaded mounds 33 and 34 are integrally formed on the inside of the upper member 11 to receive fastening means such as screws 35 and 36 for assembling the lower handle portion 12 to the upper member 11.

Referring now to the lower handle portion 12, apertures 37 and 38 are provided to allow screws 35 and 36 to pass through and mate with upper member 11. The lower handle portion 12 also includes a large aperture 39 from which a portion of the clip assembly 13 protrudes when the device is fully assembled. Included in the rear portion of the interior of the lower handle portion 12 are lower mounting members, such as lower mounting member 40, which, with the upper mounting members on the upper member 11 defines a circular aperture for receiving the rod extension portions of the clip assembly 13.

Figure 4:
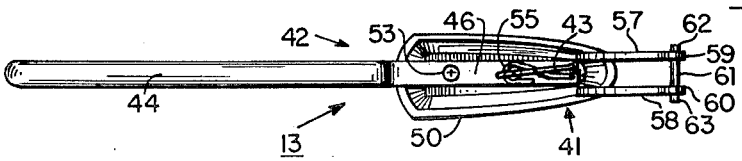
FIG. 4 is a top plan view of the clip assembly used in the hair roller device in accordance with this invention.

FIG. 4 best depicts the clip assembly 13 which includes an integrally formed clip release button member 41 and a generally Z-shaped clip member 42 as well as a single turned wire or spring clip 43.

The clip member 42 includes an upper portion 44 which is generally horizontal with respect to the upper surface of the rod portion 15 which ends in a tapered portion 45 at an end proximate the cool tip 16. The clip member 42 also includes vertical portion 60 which is disposed through the aperture 22 of the upper member 11 and lower horizontal portion 46 with apertures 47 and 48 defined therein for mounting on the button member 41. The clip member 42 may be formed of a non-conductive material or a conductive material since it has a relatively small mass. The bottom surface 49 of the upper portion 44 of clip member 42 may be generally arcuate in cross section to conform to the general cylindrical shape of an associated roller. When the clip assembly 13 is fully assembled in the hair roller device 10, the bottom surface 49 of the upper portion 44 of the clip member 42 is slightly separated from the top surface of the rod portion 15 for ease of coupling with an associated roller.

The clip release button member 41 is likewise preferably formed from a non-conductive plastic such as polyester and includes button portion 50 with its upstanding threaded mounts 51 and 52 for receiving associated screws 53 and 54 respectively which secure the lower horizontal portion 46 of the clip member 42 to the button portion 50 of the clip release button member 41.

As depicted in the drawings, the spring clip 43 is also secured to the button member 41 proximate a first end portion 55 by means of screw 54. The second end portion 56 of the spring clip 43 is urged against the hollow interior upper surface of the upper handle portion 14 to achieve a normally biased position with respect to the clip assembly 13, in the manner illustrated in FIG. 2. FIG. 3 illustrates the device 10 when a compression force is applied by the user pressing the button portion 50 of the clip release button member 41 to cause the upper portion 44 of the clip member 42 to separate in a generally horizontal position from the center axis of the rod portion 13.

Figure 6:
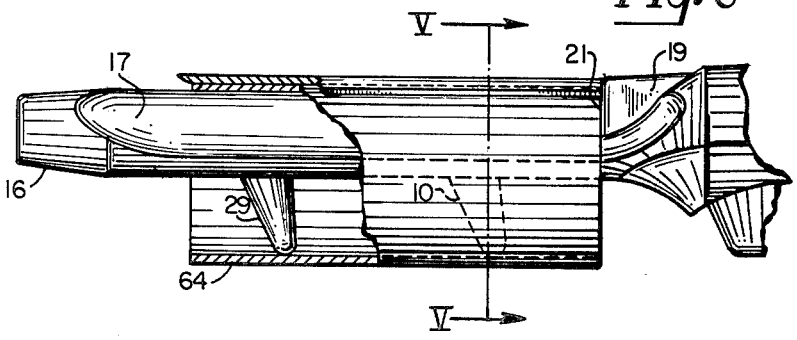
FIG. 6 is a side view partial in section of a portion of the hair roller device including a larger roller in accordance with this invention.
Figure 7:
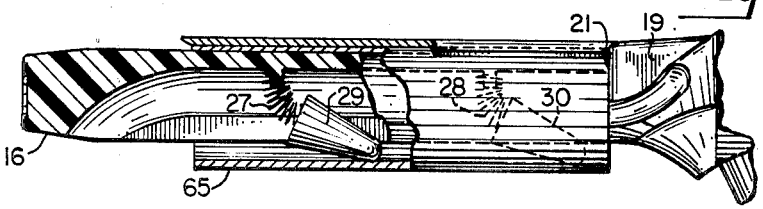
FIG. 7 is a side view partial in section of a portion of the hair roller device including a smaller roller in accordance with this invention.

Referring to FIG. 4, extending from the rear of the button portion 50 of the clip release button 41 are arms 57 and 58, which form support ends 59 and 60, respectively, which support a rod member 61 which includes rod extension portions 62 and 63. The rod extension portions 62 and 63 ride in the aperture formed by the mating of the upper and lower mounting members of the upper member 11 and lower handle portion 12 to provide a back hinge pivot toward the rear end of the hair roller device 10 to ultimately provide a generally horizontal movement of the upper portion 44 of the clip member 42 from the top of the rod portion 16 to lessen the possibility of hair pull. FIG. 6 illustrates the proper mounting of a larger roller 64 on the device 10 and FIG. 7 illustrates the proper mounting of a smaller roller 65 on the deivce 10, both rollers being urged against the stop edge 21 of wall member 19. The rollers are preferably constructed of a heat-conductive metal such as anodized aluminum and include a smooth outer surface to leave no marks in the hair and provide tangle free use. The general size of the rollers may, in a preferred embodiment, be a ¾ inch outside diameter for the smaller roller 65 and an inch and one-eighth outside diameter for the largest roller 64.

In operation, and referring to either FIG. 6 or FIG. 7, as long as the stack-up height "a" from the top of the rod portion to the bottom of the relaxed leg member is greater than the inside diameter of the associated roller, proper operation will result which will insure that the associated roller is secured on the rod portion of the hair roller device even when the upper portion 44 of the clip assembly 13 is removed from the surface of the roller. Note that the design of the hair roller device will allow the rollers to be secured without touching the heated rollers or without depressing the button portion 50 of the clip release button member 41. This is accomplished by merging the hair roller device 10 toward the roller for mounting in the space provided between the surface 49 of the upper portion 44 of clip member 42 until the back portions of the roller abuts stop edge 21 of the wall members. When the roller is to be urged off the rod portion of the hair roller device, such as by means of an edge of an associated heating chamber, resistance toward such removal until the spring is compressed, moves past vertical allowing the spring to decompress and release its frictional hold on the associated roller.

When it is desirable to leave the heated roller in the hair for a more permanent tighter curl, the use of an associated plastic or other non-conductive clamp, bobbie pin or the like may be used to aid in urging the roller off the rod portion of the hair roller device and secure it in place in the hair until later removal.

Any manner well known in the art may be used to heat the conductive rollers such as a trough shaped heating chamber which allows heat-up of the plurality of different sized rollers to be drawn from separate outlets. The heat may be transmitted to the rollers through conduction radiation or the like from a state of the art heater or oven. A suitable operating temperature for the rollers is 150° C.

Thus, it has been shown that the use of the hair roller device of this invention will allow a product to be utilized both as a curling iron and as a hair setter and still hold on a roller even when the clip assembly is in its open position such as when one may be preparing a tress or when holding the hair roller device in a downward position. The upper portion 44 of the clip member 42 is raised by depressing the button portion 50 of the clip release button member 41 when one wishes to place a section of the hair being curled between the heated roller and the upper portion 44 of the clip member 42. The clip assembly 13 is relaxed into its normally biased position to close the clip member 42 and the user grasps the end of the hair tress being curled. By manipulating the cool tip portion 16, the desired curling operation may be performed.

Tighter curls may be made by sliding the rod portion 15 of the hair roller device 10 as far as it will go into the roller and positioning the section of the hair to be curled between the heated roller and the upper portion 44 of clip member 42. The clip member 42 is then closed with the end of the hair just extending beyond the tapered portion 45 of the clip member 42. The cool tip portion 16 is then grasped and while keeping the section of the hair taunt, the curl is wound toward the user's scalp by turning the handle with one hand and the cool tip with the other. A solid plastic clamp or the like that corresponds to the size roller chosen is then snapped over the roller and hair and without pressing the button portion 50 of the clip release button member 41, the user holds the roller and plastic clamp securely in place with one hand and withdraws the hair roller device from the roller with the other. This process is repeated continually until all the curls the user desires are completed.

When looser curls are desired, the same general procedure is followed, however, instead of placing a plastic clamp or the like over the curl, the user merely holds the device in place for at least ten seconds. The operator would then unwind slightly to loosen the curl and push the button portion 50 of the clip release button member 41 and withdraw the hair roller device (with roller still attached) from the center of the curl.

While an embodiment and application of this invention has been shown and described, it will be apparent to those skilled in the art that many more modifications will be possible without departing from the inventive concepts herein described.

What is claimed and desired to be secured by Letters Patent is:

1. In combination with a plurality of generally cylindrical conductive interchangeable rollers of different inside diameters for making curls, a non-electric hair roller device including, a handle portion for gripping the device and a non-conductive rod portion coupled to said handle portion, normally biased clip means coupled to the device for frictionally holding a roller mounted on said rod portion, clip button means coupled to the device for releasing tension of said clip means on the roller, and compressible support leg means pivotably connected to said rod means for retaining the roller on the device when said clip button means is activated thereby releasing tension on the roller, said support leg means including a spring member connecting a non-conductive peg to said rod portion, the stack-up height of said support leg means and said rod being greater than the inside diameter of the roller.

2. A hair roller device as in claim 1 wherein said rollers have a smooth outer surface.

3. A hair roller device as in claim 1 wherein said rod portion is generally triangular in cross-section and includes a grooved portion for receiving a portion of said leg means in a forward and rearward position.

4. A hair roller device as in claim 1 wherein said support leg means includes more than one support leg.

5. The hair roller device as in claim 1 wherein said clip button means is pivotally mounted proximate an end of said handle portion opposite said rod portion and a part of said clip means is movable from said rod portion in a generally parallel manner when said clip button means is compressed.

6. A device for manipulating heat conductive cylindrical hair rollers comprising:

handle means for holding the device;

non-conductive rod means connected to said handle means;

normally biased clip assembly means for releasably engaging associated rollers of different inside diameters, said clip assembly means including a clip member having a horizontal portion generally parallel to said rod means;

clip release button means associated with said handle means for activating said clip assembly means and positioning said clip member away from said rod means; and movable support let means connected to said rod means for releasably engaging the inner surface of the associated roller, said support leg means including at least one spring member connecting a non-conductive peg to said rod portion, the stack-up height of said support leg means and rod means being greater than the inside diameter of the roller.

7. The device as in claim 6 wherein said rod means includes a longitudinal groove and said leg means is pivotally coupled to said rod means in the groove.

8. The device as in claim 7 wherein an end of said rod means opposite said handle means forms a cool tip for gripping and turning the device.

9. The device as in claim 8 wherein said rod means is an elongated shaft having a generally triangular cross-section.

10. The device as in claim 6 wherein said movable support leg means is compressible and the stack-up height is sufficient to retain the roller on the device when said clip release button means is activated and releases said clip assembly means from said rod means.

* * * * *